US009035791B2

(12) United States Patent
Matsumoto et al.

(10) Patent No.: US 9,035,791 B2
(45) Date of Patent: May 19, 2015

(54) DATA COLLECTION METHOD AND DATA COLLECTION SYSTEM

(75) Inventors: Junichi Matsumoto, Toyota (JP); Yasuhide Kurimoto, Kasugai (JP); Kazuo Tojima, Toyota (JP); Yoshitaka Kiuchi, Kariya (JP)

(73) Assignees: Toyota Jidosha Kabushiki Kaisha, Toyota-shi (JP); Denso Corporation, Kariya (JP)

( * ) Notice: Subject to any disclaimer, the term of this patent is extended or adjusted under 35 U.S.C. 154(b) by 294 days.

(21) Appl. No.: 13/544,366

(22) Filed: Jul. 9, 2012

(65) Prior Publication Data

US 2013/0015982 A1 Jan. 17, 2013

(30) Foreign Application Priority Data

Jul. 12, 2011 (JP) ..... 2011-153898

(51) Int. Cl.
*G08C 15/06* (2006.01)
*G06Q 50/06* (2012.01)

(52) U.S. Cl.
CPC ..... *G06Q 50/06* (2013.01)

(58) Field of Classification Search
CPC ..... G06Q 50/06; Y02E 60/12; H01M 10/48; G01R 31/3648; G01R 31/3679; G01R 19/16542; G01R 31/3662; G01R 31/361; G08B 29/181; H02J 7/0047; G01D 4/004; H04Q 9/00; Y02B 90/242; Y04S 20/322; G01F 15/063; G08C 15/06
USPC ..... 340/870.02
See application file for complete search history.

(56) References Cited

U.S. PATENT DOCUMENTS 7,319,848 B2 1/2008 Obradovich et al.
2003/0137277 A1* 7/2003 Mori et al. ..... 320/132
(Continued)

FOREIGN PATENT DOCUMENTS

CN 101071889 A 11/2007
JP 2002-150343 A 5/2002
(Continued)

OTHER PUBLICATIONS

"Advent of Epoch Premised on Connection to Internet Open Environment Created by HTML.5", Nikkei Electronics, Japan, Nikkei BP Inc., Jun. 27, 2011, No. 1059, pp. 44 to 54.
(Continued)

*Primary Examiner* — Omer S Khan
(74) *Attorney, Agent, or Firm* — Gifford, Krass, Sprinkle, Anderson & Citkowski, P.C.

(57) ABSTRACT

A data collection system that collects information indicating a status of a battery mounted on a vehicle from the vehicle after shipment from a factory, includes a battery information collection server that is configured to periodically receive information of the battery and identification information, with which it is possible to identify the vehicle, that are transmitted wirelessly from a computer that is mounted on the vehicle and is configured to acquire and store the information of the battery mounted on the vehicle. The data collection system may further include a battery information analysis section that is configured to display a result of associating the information of the battery received by the battery information collection server with each vehicle using the identification information.

2 Claims, 6 Drawing Sheets

(56) References Cited

U.S. PATENT DOCUMENTS

| | | | | |
|---|---|---|---|---|
| 2009/0198372 | A1* | 8/2009 | Hammerslag | 700/226 |
| 2011/0032110 | A1* | 2/2011 | Taguchi | 340/636.1 |

FOREIGN PATENT DOCUMENTS

| | | | |
|---|---|---|---|
| JP | 2003-256980 | A | 9/2003 |
| JP | 2007-213324 | A | 8/2007 |

OTHER PUBLICATIONS

Takeo Fukuda, "Close-up", Nikkei Computer, Japan, Nikkei BP Inc., Jul. 7, 2011, No. 786, pp. 74 to 79.

"Get Hold of Charging Infrastructure to Conquer Cars and Houses by Electric Power" Nikkei Electronics, Japan, Nikkei BP Inc., Mar. 22, 2010, No. 1026, pp. 40 to 47.

* cited by examiner

DATA COLLECTION METHOD AND DATA COLLECTION SYSTEM

CROSS REFERENCE TO RELATED APPLICATIONS

This application claims priority to Japanese Patent Application No. 2011-153898 filed on Jul. 12, 2011, which is incorporated herein by reference in its entirety including the specification, drawings and abstract.

BACKGROUND OF THE INVENTION

1. Field of the Invention

The invention relates to a data collection method and a data collection system and particularly to a data collection method and a data collection system that collect information indicating a status of a part of a vehicle from the vehicle after shipment from a factory.

2. Description of Related Art

Japanese Patent Application Publication No. 2007-213324 (JP 2007-213324 A) discloses a technique that transmits data relating to the vehicle from the vehicle. In this technique, vehicle driving information indicating the driving status of the vehicle is collected in the vehicle and stored on a data logger. Stored vehicle driving information is periodically transferred from an on-vehicle terminal to a driving evaluation server through a communication network.

In recent years, vehicles such as electric vehicles and hybrid vehicles that are equipped with a traction motor and a battery attract attention. Regarding such vehicles, it is desirable to collect much more data about how the battery is used in the market in order to improve the reliability of the vehicle to be developed in the near future.

On the vehicle, information relating to the battery is measured or estimated to be used for vehicle control. Thus, it is conceivable that the information relating to the battery is stored in a memory and the like in the vehicle. However, in order to collect the stored information, it is required that an information collection device is physically connected to the memory in the vehicle to acquire the information, or a unit that includes the memory storing the information (for example, a battery monitoring ECU) is obtained from the vehicle.

JP 2007-213324 A describes a system that periodically transmits the data from the vehicle to the server through the communication network. However, the technique disclosed in the above publication is to collect the vehicle driving information through a network to make possible an appropriate evaluation of the vehicle in a used car market, and there is no description nor suggestion in the cited publication about collection and management of the information on the battery that is mounted on the hybrid vehicle or the electric vehicle for each vehicle.

SUMMARY OF THE INVENTION

The invention provides a data collection method and a data collection system that can collect and manage for each vehicle the information of a battery mounted on a vehicle.

A first aspect of the invention is a data collection method of collecting information indicating a status of a battery mounted on a vehicle from the vehicle after shipment from a factory, including: acquiring and storing the information of the battery mounted on the vehicle in a computer of the vehicle; and periodically transmitting the information of the battery stored in the computer from the vehicle to a battery information collection server wirelessly.

A second aspect of the invention is a data collection system that collects information indicating a status of a battery mounted on a vehicle from the vehicle after shipment from a factory, including a battery information collection server that is configured to periodically receive information of the battery and identification information, with which it is possible to identify the vehicle, that are transmitted wirelessly from a computer that is mounted on the vehicle and is configured to acquire and store the information of the battery mounted on the vehicle.

According to the invention, the information of the battery mounted on the vehicle can be collected and managed for each vehicle, and therefore the information of batteries used under various conditions can be acquired and analyzed easily, and a deterioration state of the battery for each vehicle can be collectively managed.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
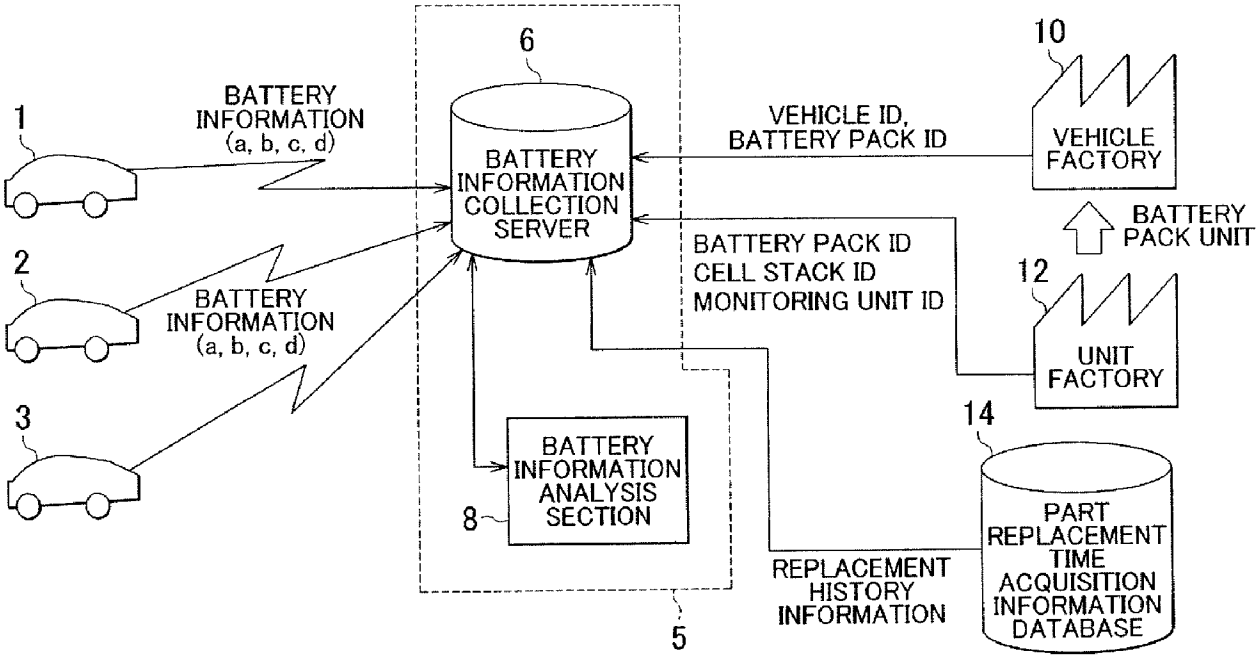
FIG. 1 is a diagram that illustrates a data collection system according to an embodiment of the invention.

Hereinafter, embodiments of the invention will be described in detail with reference to attached drawings. The same or equivalent part in the drawings is given with the same reference numeral and symbol, and its description is not repeated.

FIG. 1 is a diagram that illustrates the data collection system according to this embodiment. Referring to FIG. 1, the data collection system 5 includes a battery information collection server 6 and a battery information analysis section 8. The battery information (including the information a, b, c, and d) is transmitted wirelessly from the vehicles 1 through 3 to the battery information collection server 6. The battery pack ID of a shipped battery pack and the identification of a cell stack (hereinafter, also referred to simply as "a battery cell") contained in the battery pack and a monitoring unit (cell stack ID and monitoring unit ID) are transmitted from a unit factory 12 to the battery information collection server 6 so that the battery information collection server 6 can verify parts within the battery pack.

The unit factory 12 makes shipment of the assembled battery pack unit to a vehicle factory 10. In the vehicle factory 10, the battery pack unit is incorporated into a vehicle. The combined information of the vehicle ID of the shipped vehicle and the battery pack ID of the battery pack incorporated into the vehicle is transmitted from the vehicle factory 10 to the battery information collection server 6.

The battery pack may be replaced due to failure when used in the market after it is incorporated into the vehicle. There is also a case where the parts inside the battery pack (the cell stack, the monitoring unit, and the like) are replaced. Such information of part replacement is transmitted from a part replacement time acquisition information database 14 in a repair shop and the like to the battery information collection server 6 in the case of the replacement.

The battery information analysis section 8 analyzes the information related to the battery cell that is collected to the battery information collection server 6 in accordance with conditions specified by an operator to show on a display or print out the information so as to be easily visible to the operator.

Figure 2:
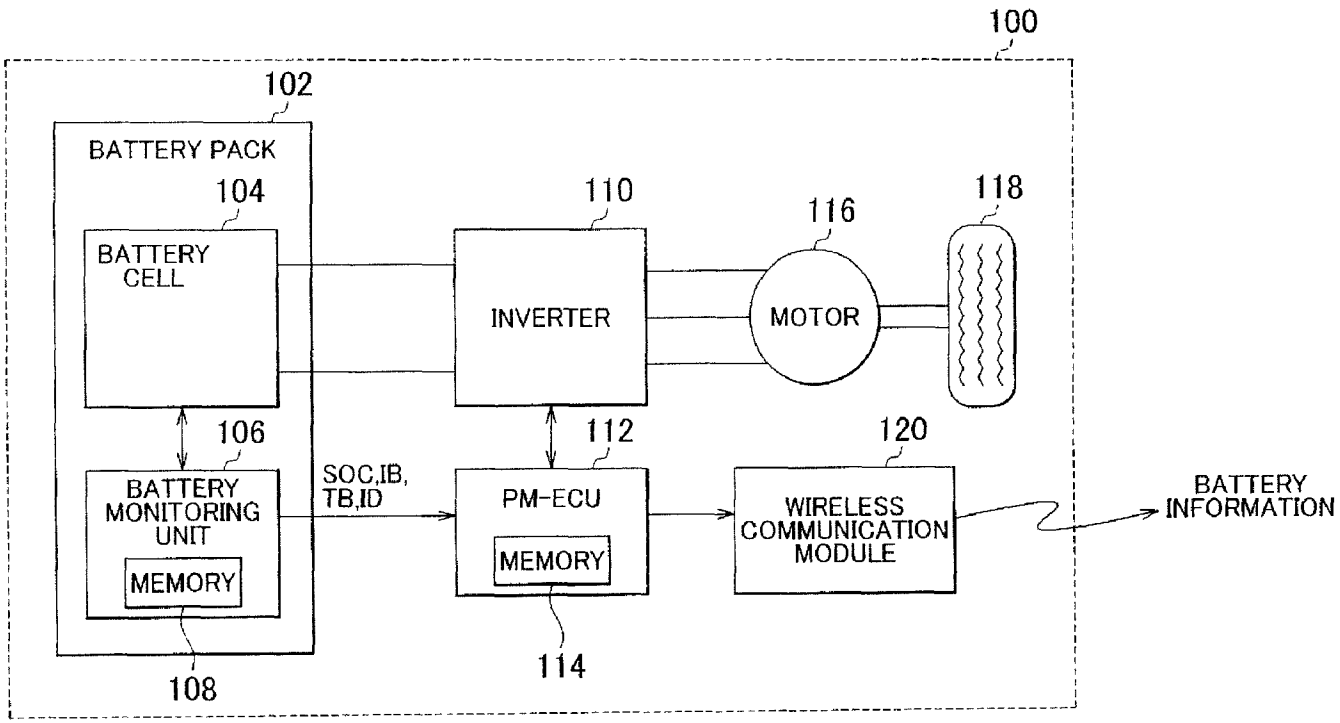
FIG. 2 is a block diagram that shows a configuration of a vehicle.

FIG. 2 is a block diagram that shows a configuration of the Vehicle. The vehicle 100 is an example, in which a configuration of the vehicles 1 through 3 in FIG. 1 is shown. The vehicle 100 presents an example of an electric vehicle; however, the vehicles 1 through 3 in FIG. 1 may be a hybrid vehicle that is additionally equipped with an engine, or a fuel cell vehicle that is additionally equipped with a fuel cell, and are not limited to the electric vehicle as long as a battery cell is mounted.

With reference to FIG. 2, the vehicle 100 includes a battery pack 102, an inverter 110, a motor 116, a wheel 118, a power management electronic control unit (hereinafter referred to as PM-ECU) 112, and a wireless communication module 120.

The battery pack 102 includes a battery cell 104 (also referred to as a cell stack) and a battery monitoring unit 106. The battery cell 104 is a secondary battery such as a nickel hydride battery or a lithium-ion battery. The battery monitoring unit 106 includes a memory 108. The battery monitoring unit 106 periodically measures or estimates various data (electric currents, voltages, temperatures, resistance, state of charge (SOC), etc.) of the battery cell 104 to store in the memory 108.

The PM-ECU 112 and the battery monitoring unit 106 are computers on installed in the vehicle.

The inverter 110 receives electric power from the battery cell 104 in the battery pack 102 and drives the motor 116. The motor 116 drives the wheel 118 through a differential gear (not shown) etc.

The PM-ECU 112 receives various data (electric currents, voltages, temperatures, resistance, and SOC, etc.) of the battery cell 104 from the battery monitoring unit 106 and controls the inverter 110 in accordance with the data. In addition, the PM-ECU 112 includes a memory 114, and the memory 114 stores a vehicle ID that is engraved on a vehicle frame.

The PM-ECU 112 periodically (for example, once a month or every three months) reads out, from the battery monitoring unit 106, the various data of the battery cell 104 measured by the battery monitoring unit 106 and stored in the memory 108 and the battery monitoring unit ID to transmit from the wireless communication module 120 to the battery information collection server 6 shown in FIG. 1. The battery information collection server 6 uses the battery monitoring unit ID as a key to distinguish the transmitted various data of the battery cell 104 from those of other battery cells. Other identification than the battery monitoring unit ID may be used as long as the ID is unique so that a specific unit can be identified.

In the example described above, the various data (electric currents, voltages, temperatures, resistance, SOC, etc.) of the battery cell 104 is periodically measured or estimated, and stored in the memory 108; however, the data may be stored in the memory 114 instead of the memory 108.

Figure 3:
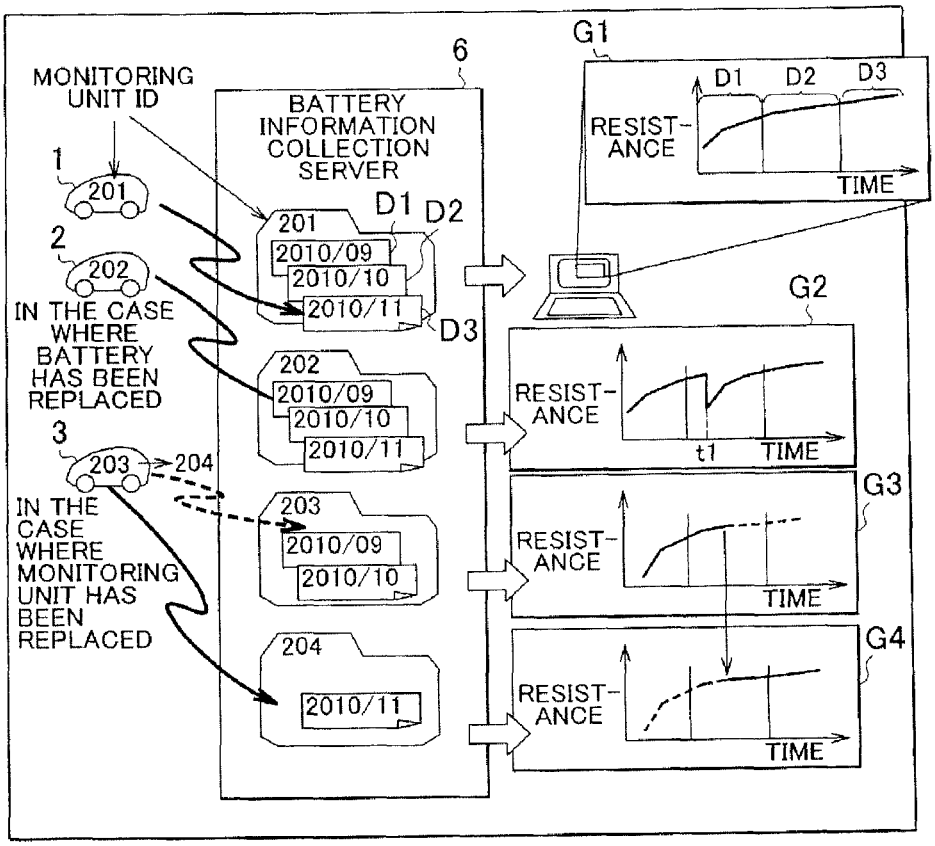
FIG. 3 is a diagram that shows an operational image of the data collection method according to an embodiment of the invention.

FIG. 3 is a diagram that shows an operational image of the data collection method according to an embodiment. Referring to FIG. 3, the data of the vehicles through 3 is stored in the battery information collection server 6 in which the monitoring unit ID is used as a key.

On the vehicle 1, the monitoring unit with the monitoring unit ID of "201" is mounted. The vehicle 1 wirelessly transmits the various data of the battery cell along with the monitoring unit ID of "201" to the battery information collection server every month. The battery information collection server 6 stores data files D1, D2, and D3 as the data of the monitoring unit ID "201" so as to be able to extract later. The data files D1, D2, and D3 include various monthly data (the data used in the analysis of, for example, deterioration of the battery such as electric currents, voltages, temperatures, resistance, and SOC) measured or estimated on the vehicle in September, October, and November of 2010, respectively.

The battery information analysis section 8 uses the monitoring unit ID "201" as the key to extract the data of the data files D1, D2, and D3 from the battery information collection server, organizes the data in chronological order as shown in a graph G1, and displays, for example, the variation in resistance of the battery on a screen of a display section.

Figure 4:
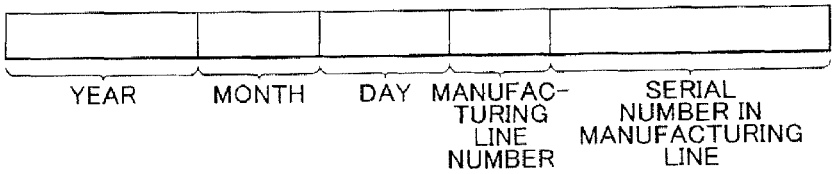
FIG. 4 is a diagram that illustrates one example of assignment of a monitoring unit ID.

FIG. 4 is a diagram that illustrates one example of assignment of a monitoring unit ID. Referring to FIG. 4, the monitoring unit ID is assigned with a different number from one another if the type of the battery monitoring unit is the same, and there is no identification identical to another. For example, the identification is created by using the date of manufacturing, a manufacturing line number, and a serial number in the manufacturing line in this order from the highest-order bit, and therefore a unique sequence (for example, a 32-bit sequence) is realized.

Referring again to FIG. 3, when the battery cell 104 inside the battery pack 102 of FIG. 1 is replaced and the battery monitoring unit 106 is used as is as shown in the case of the vehicle 2, the data has a discontinuity as shown in a graph G2. In this case, the battery information analysis section 8 can obtain the information that indicates the replacement of the battery from the battery information collection server 6 and therefore can handle the data before time t1 as the data of another battery and analyze the deterioration of the battery using the data after the time t1 only.

It is conceivable that the battery monitoring unit 106 inside the battery pack 102 of FIG. 1 is replaced and the battery cell 104 is used as is as shown in the case of the vehicle 3. In this case, the monitoring unit ID transmitted from the vehicle 3 is changed from "203" to "204" in the middle of the process. The battery information collection server 6 may store the battery data for September and October of 2010 to be extractable with the monitoring unit ID "203" and the battery data for November of 2010 to be extractable with the monitoring unit ID "204", The battery information analysis section 8 can merge a graph G3 into the first half of a graph G4 to display by separately obtaining the information in which the monitoring unit ID is changed from "203" to "204".

Figure 5:
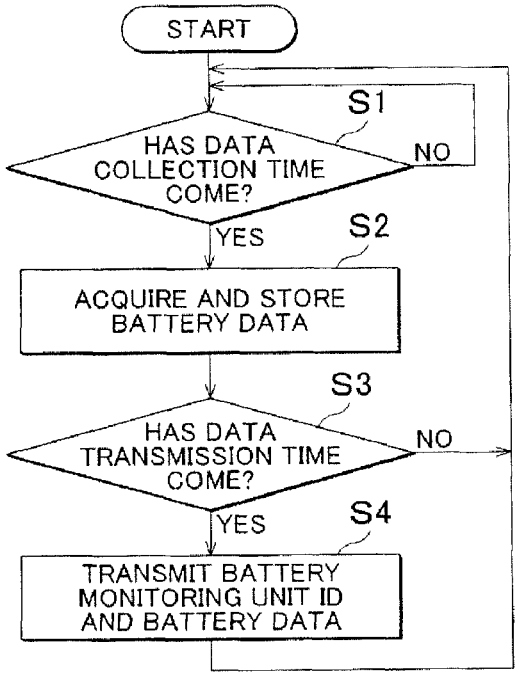
FIG. 5 is a flowchart that shows control of data acquisition and transmission performed in the vehicle.

FIG. 5 is a flowchart that shows the control of data acquisition and transmission performed in the vehicle.

Referring to FIG. 2 and FIG. 5, when the processing is started, the battery monitoring unit 106 determines in a step S1 whether a data collection time (for example, once a day) has come. In the step S1, when the data collection time has not come yet, the wait is resumed in the step S1. The data collection may be performed to acquire the maximum or the minimum value of the data accumulated from the beginning to the end of a specified period (for example, one day).

In the step S1, when the data collection time comes, the processing proceeds to a step S2, and the acquisition of the battery data and storage in the memory 108 is performed. Then, the processing proceeds to a step S3.

In the step S3, the PM-ECU 112 determines whether a data transmission time (for example, once a month) has come. In the step S3, when it is determined that the data transmission time has not come yet, the processing returns to the step S1.

In the step S3, when it is determined that the data transmission time has come, the processing proceeds to a step S4, and the PM-ECU 112 reads out the battery information and the battery monitoring unit ID that are stored in the memory 108 inside the battery monitoring unit 106 and uses the wireless communication module 120 to transmit to the battery information collection server 6 wirelessly.

In the step S4, when the data transmission is completed, the processing returns to the step S1, and the storage of the battery data to the memory in the vehicle is started again. When the memory capacity becomes insufficient, the memory may be cleared after the data is transmitted to the battery information collection server 6, and then the storage of the battery data may be started.

Figure 6:
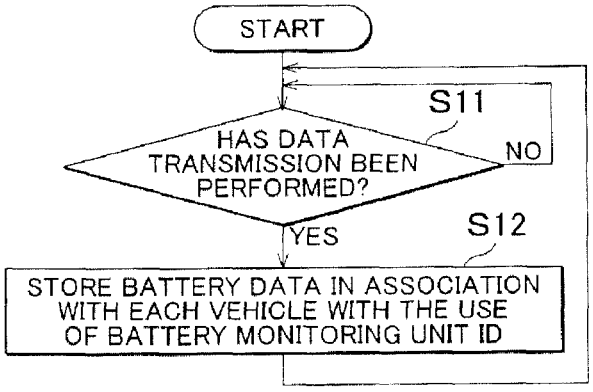
FIG. 6 is a flowchart that shows control performed in a battery information collection server.

FIG. 6 is a flowchart that shows the control performed in the battery information collection server.

Referring to FIG. 1 and FIG. 6, in a step S11, the battery information collection server 6 determines whether the data transmission from the vehicles 1 through 3 has been performed. In the step S11, when the data transmission is not performed, a data transmission detection is waited again in the step S11.

In the step S11, when the data transmission is performed, the processing proceeds to a step S12. In the step S12, the battery information collection server 6 stores the battery data in association with each vehicle using the battery monitoring unit ID as shown in FIG. 3. It suffices that the data can be extracted in accordance with the battery monitoring unit ID and the relationship between the battery data and the battery monitoring unit ID can be identified.

In the step S12, when the storage of the battery data is completed, the processing returns to the step S11 again, and the processing enters an upcoming data transmission waiting state from the vehicles 1 through 3.

Figure 7:
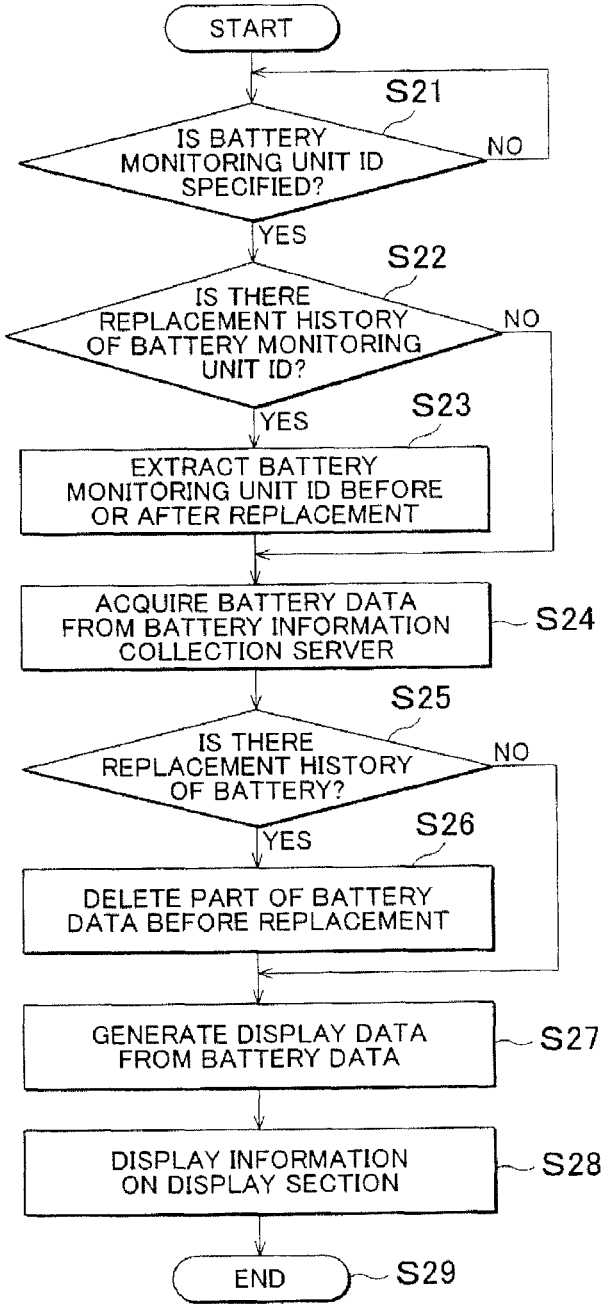
FIG. 7 is a flowchart that shows processing performed in a battery information analysis section.

FIG. 7 is a flowchart that shows the processing performed in the battery information analysis section 8. Referring to FIG. 1 and FIG. 7, when the processing is started, the battery information analysis section 8 determines in a step S21 whether the battery monitoring unit ID is specified by the user. The battery monitoring unit ID is the information that is used as the key to extract the battery data for each vehicle, In the step S21, the processing starts waiting for specification until the battery monitoring unit ID is specified. In the step S21, when the battery monitoring unit ID is specified, the processing proceeds to a step S22.

In the step S22, the battery information analysis section 8 determines whether there is replacement history of the specified battery monitoring unit ID. The presence or absence of the placement history can be determined by referring to the replacement history information that is transmitted from the part replacement time acquisition information DB 14 to the battery information collection server 6 and stored in the battery information collection server.

In the step S22, when there is the replacement history of the battery monitoring unit, the processing proceeds to a step S23. In the step S23, the battery monitoring unit ID before or after the replacement is extracted.

When there is no replacement history of the battery monitoring unit in the step S22, or when the battery monitoring unit ID before or after the replacement is extracted in the step S23, the processing proceeds to a step S24, and the battery data is acquired from the battery information collection server.

Figure 8:
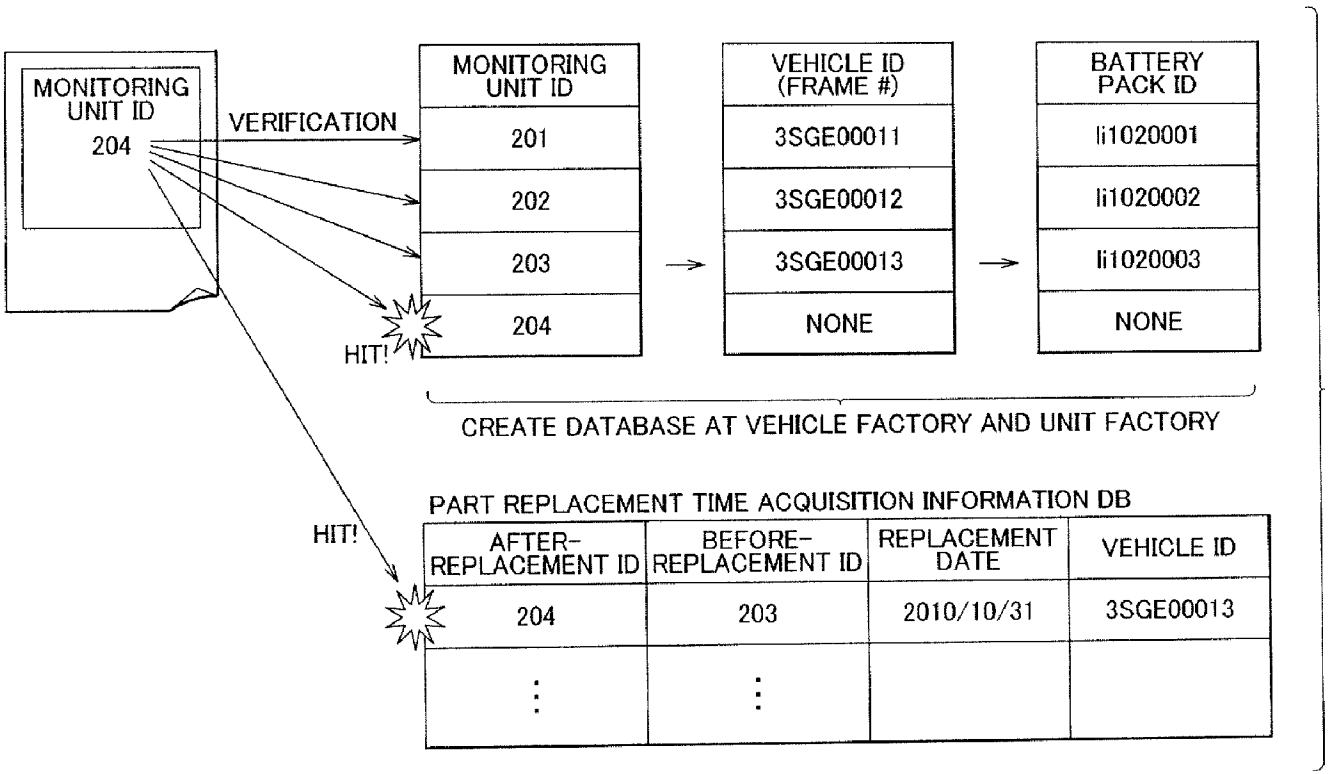
FIG. 8 is a diagram that illustrates verification of battery data when a battery monitoring unit has been replaced.

FIG. 8 is a diagram that illustrates the verification of the battery data when the battery monitoring unit has been replaced.

Referring to FIG. 1 and FIG. 8, the vehicle ID and the battery pack ID that indicates the battery pack incorporated into the vehicle specified by the vehicle ID are transmitted from the vehicle factory 10 to the battery information collection server 6.

Furthermore, the battery pack ID, the identification of the cell stack incorporated into the battery pack specified by the battery pack ID, and the monitoring unit ID are transmitted from the unit factory to the battery information collection server 6.

In addition, the data that shows the correspondence between the identifications of a part before and after the replacement that is replaced during repair is transmitted from the part replacement time acquisition information database 14 to the battery information collection server 6.

The case shown in FIG. 3 where the battery data relating to the vehicle 3 is acquired will be described with reference to FIG. 8. When the operator of the battery information analysis section 8 inputs the monitoring unit ID="204", in the step S22 of FIG. 7, the battery information analysis section 8 refers to the data stored in the battery information collection server 6 to acquire the information about the monitoring unit ID "204". It is revealed that the monitoring unit ID "204" does not have any corresponding vehicle ID or battery pack ID at the time of assembling in the vehicle factory and the information from the part replacement time acquisition information DB reveals that the monitoring unit ID "203" has been replaced with the monitoring unit ID "204" during the repair on Oct. 31, 2010.

Therefore, the data on the graph G3 in FIG. 3 is transferred to the graph G4, and the merged graph is displayed on the display section in later steps S27 and S28. Accordingly, the operator can find out how the battery mounted on the vehicle has been used.

It is conceivable that the monitoring unit ID of the failed unit before the replacement may be specified in the step S1 of FIG. 7. In this case, in the steps S27 and S28, the graph G3 merged with the data of the graph G4 in FIG. 3 is displayed.

Referring again to FIG. 7, in the step S24, when the acquisition of necessary battery data from the battery information collection server is completed, in a next step S25, it is determined whether there is the replacement history of the battery cell 104 inside the battery pack 102. When the battery cell 104 is replaced due to repair or the like, the data has the discontinuity as shown in the graph G2 of FIG. 3. It is not appropriate to treat such data as the data of one battery cell. Therefore, in a step S26, the battery information analysis section 8 deletes the part of battery data before replacement.

For the determination of the replacement history of the battery cell 104, the age of the battery cell (elapsed time from the installation of the battery cell) may be stored in addition to the electric current and resistance that are monitored by the battery monitoring unit and transmitted as one of the data. The age of the battery is reset to zero when the battery cell 104 is replaced. Thus, the battery information analysis section 8 determines that the battery cell was replaced when a discontinuity appears in the age of the battery (when the age was reset to zero, returned to a smaller value, or increased more than expected).

In the step S25, when it is determined that there is the replacement history of the battery cell 104 inside the battery pack 102, in order to include only the battery that is currently mounted on the vehicle as the subject of data collection, the processing proceeds to the step S26 where the battery information analysis section 8 deletes the part of battery data that corresponds to the data before replacement, and then the processing proceeds to the step S27. On the other hand, in the step S25, when it is determined that there is no replacement history of the battery cell 109 inside the battery pack 102, the processing of the step S26 is not performed, and the processing proceeds to the step S27.

In the step S27, display data is generated from the battery data that has been acquired in the step S24 and in which unnecessary part has been deleted in the step S26. In the step S28, the information is displayed on the display section such as a liquid crystal display so that the operator can understand. The displayed information includes a histogram and/or a line chart of internal resistance of the battery, full charging capacity, charge and discharge current, battery temperature, etc. When the display processing in the step S28 is completed, the processing executed by the battery information analysis section 8 is completed in a step S29.

As described above, in this embodiment, the battery monitoring unit mounted in the battery pack to monitor the status of the battery stores the ID that is uniquely managed for the battery pack. Also, this embodiment is characterized in that necessary data (such as the histogram of the internal resistance of the battery, full charging capacity, charge and discharge current, battery temperature, etc.) is collected along with the ID through a network.

According to the above features, a deterioration state of the battery for each vehicle can be collectively managed. In addition, more accurate data management can be realized by the acquisition of the history of part replacement and the verification of the information with the collected data as described above.

Finally, this embodiment is summarized with reference to FIG. 1 and FIG. 2 again. This embodiment relates to a data collection system that collects the information indicating the status of the battery mounted on the vehicle from the vehicle after the shipment from a factory. The data collection system includes: the battery information collection server 6 that periodically receives the information of the battery and the identification information (battery monitoring unit ID) with which it is possible to identify the vehicle that are transmitted wirelessly from a vehicle-side computer (any of the battery monitoring unit 106 and the PM-ECU 112) that acquires and stores the information of the battery mounted on the vehicle; and the battery information analysis section 8 that displays the result of associating the information of the battery in the battery information collection server 6 with each vehicle using the identification information.

Preferably, the vehicle 100 is equipped with the battery pack 102 including the battery cell 104 and the battery monitoring unit 106 for monitoring the battery cell 104. As shown in FIG. 3, FIG. 7, and FIG. 8, the battery information analysis section 8 refers to the identification information (battery monitoring unit ID), the information of the battery cell 104 corresponding to the identification information (battery monitoring unit ID), the replacement history of the battery monitoring unit 106, and the replacement history of the battery cell 104, extracts the information of the battery cell 104 corresponding to the battery monitoring unit 106, and processes the extracted information to display on a display device or the like.

The embodiments disclosed herein are to be considered in all respects as illustrative and not restrictive. The scope of the invention is indicated by the appended claims rather than by the foregoing description, and all changes that come within the meaning and range of equivalency of the claims are therefore intended to be embraced therein.

When the information of the battery is transmitted, the identification information, with which it is possible to identify the vehicle, and the information of the battery are transmitted to the battery information collection server, and the data collection method may further include storing, in the battery information collection server, the information of the battery in association with the vehicle using the identification information.

The identification information is stored in a battery monitoring control unit incorporated into the battery pack having the battery cell, and when the information of the battery is transmitted, the identification information and the battery information in which the variation in the status of the battery during a specified period is recorded may be read from the battery monitoring control unit and transmitted to the battery information collection server.

The data collection method may further include referring to the identification information, the information of the battery corresponding to the identification information, the replacement history of the battery monitoring control unit, and the replacement history of the battery incorporated into the battery pack, and extracting the information of the battery corresponding to the battery monitoring control unit, and processing to display the extracted information.

The vehicle may be equipped with the battery pack including the battery and the battery monitoring control unit that is configured to monitor the battery, and the battery information analysis section may be configured to refer to the identification information, the information of the battery corresponding to the identification information, the replacement history of the battery monitoring control unit, and the replacement history of the battery incorporated into the battery pack, to extract the information of the battery corresponding to the battery monitoring control unit, and process and display the extracted information.

What is claimed is:

1. A data collection method of collecting information of a battery indicating a status of a battery mounted on a vehicle from the vehicle after shipment from a factory, the vehicle is equipped with a battery pack including the battery and a battery monitoring control unit that is configured to monitor the battery, comprising:

acquiring and storing the information of the battery mounted on the vehicle in a computer of the vehicle;

periodically transmitting the information of the battery stored in the computer from the vehicle to a battery information collection server wirelessly, when the information of the battery is transmitted, identification information, with which it is possible to identify the vehicle as an individual vehicle, and the information of the battery are transmitted to the battery information collection server, the identification information is stored in the battery monitoring control unit;

storing, in the battery information collection server, the information of the battery in association with the vehicle using the identification information;

referring to the identification information, the information of the battery corresponding to the identification information, replacement history of the battery monitoring control unit, and replacement history of the battery incorporated into the battery pack, to extract the information of the battery corresponding to the battery monitoring control unit; and processing and displaying the extracted information, wherein when the information of the battery is transmitted from the computer in the vehicle to the battery information collection server, the identification information and battery information, in which variation in the status of the battery during a specified period is recorded, are read from the battery monitoring control unit and transmitted to the battery information collection server.

2. A data collection system that collects information of a battery indicating a status of a battery mounted on a vehicle from the vehicle after shipment from a factory, the vehicle is equipped with a battery pack including the battery and a battery monitoring control unit that is configured to monitor the battery, comprising:

a battery information collection server that is configured to periodically receive information of the battery and identification information, the identification information is used to identify the vehicle as an individual vehicle, the information of the battery and identification information are transmitted wirelessly from a computer that is mounted on the vehicle, the identification information is stored in the battery monitoring control unit and the computer is configured to acquire and store the information of the battery mounted on the vehicle, the battery information collection server is configured to store the information of the battery in association with the vehicle using the identification information; and a battery information analysis section that is configured to display a result of associating the information of the battery received by the battery information collection server with each vehicle using the identification information;

wherein the battery information analysis section is configured to refer to the identification information, the information of the battery corresponding to the identification information, replacement history of the battery monitoring control unit, and replacement history of the battery incorporated into the battery pack, to extract the information of the battery corresponding to the battery monitoring control unit, and process and display the extracted information.

* * * * *